US010367282B2

(12) United States Patent
Harmon, III et al.

(10) Patent No.: US 10,367,282 B2
(45) Date of Patent: Jul. 30, 2019

(54) DUAL CONNECTOR SYSTEM

(71) Applicant: TE CONNECTIVITY CORPORATION, Berwyn, PA (US)

(72) Inventors: Dean Marlin Harmon, III, Harrisburg, PA (US); Michael David Herring, Apex, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/492,070

(22) Filed: Apr. 20, 2017

(65) Prior Publication Data

US 2018/0309215 A1 Oct. 25, 2018

(51) Int. Cl.

| | |
|---|---|
| ***H01R 12/72*** | (2011.01) |
| ***H01R 13/66*** | (2006.01) |
| ***H01R 13/629*** | (2006.01) |
| *H01R 13/627* | (2006.01) |
| *H01R 13/633* | (2006.01) |
| *H01R 12/71* | (2011.01) |
| *H01R 24/60* | (2011.01) |

(52) U.S. Cl.

CPC ..... *H01R 12/721* (2013.01); *H01R 13/62988* (2013.01); *H01R 13/665* (2013.01); *H01R 12/714* (2013.01); *H01R 12/718* (2013.01); *H01R 13/6275* (2013.01); *H01R 13/6335* (2013.01); *H01R 24/60* (2013.01)

(58) Field of Classification Search

CPC ..... H01R 12/7076; H01R 12/721; H01R 12/714; H01R 12/716; H01R 13/113; H01R 13/6275; H01R 13/62988; H01R 13/6335; H01R 13/665; H01R 13/6587; H01R 24/60

See application file for complete search history.

(56) References Cited

U.S. PATENT DOCUMENTS

| | | | | |
|---|---|---|---|---|
| 3,479,634 A | | 11/1969 | Pritulsky | |
| 4,678,252 A | | 7/1987 | Moore | |
| 5,242,312 A | | 9/1993 | Tondreault | |
| 5,260,854 A | | 11/1993 | Hileman et al. | |
| 5,324,204 A | * | 6/1994 | Lwee | G06F 1/184 361/679.32 |

(Continued)

OTHER PUBLICATIONS

Tyco Electronic, Product Specification, DDR S.O.DIMM Socket 200 Positions, Jul. 11, 2007, 5 pages.

(Continued)

*Primary Examiner* — Edwin A. Leon
*Assistant Examiner* — Matthew T Dzierzynski

(57) ABSTRACT

A dual connector system includes a host circuit board and first and second electrical connectors for electrically connecting to a module circuit board of a dual connector module. The dual connector module has a latch at a front wall movable between a latched position and an unlatched position. The latch engages a latching feature of the first electrical connector in the latched position. The dual connector module has an ejector at the front wall operably coupled to the latch. The ejector is actuated in an actuation direction to release the latch and eject the dual connector module from the mated position to the unmated position after the latch is moved from the latched position to the unlatched position.

20 Claims, 5 Drawing Sheets

(56) References Cited

U.S. PATENT DOCUMENTS 5,643,001 A * 7/1997 Kaufman ..... H01R 13/6485 439/159
6,394,817 B1 5/2002 Kihira et al.
7,018,222 B2 * 3/2006 Chang ..... H01R 13/633 439/159
7,074,090 B2 * 7/2006 Ho ..... H01R 12/52 439/326
7,101,222 B2 * 9/2006 Ho ..... H01R 27/02 439/541.5
7,300,298 B2 * 11/2007 Kameda ..... H05K 7/1417 439/326
7,344,402 B2 3/2008 Langgood et al.
7,467,963 B2 * 12/2008 Chen ..... H01R 13/631 439/327
7,470,136 B2 12/2008 Yahiro et al.
7,510,414 B2 * 3/2009 Yu ..... H01R 27/02 439/159
7,909,644 B1 3/2011 Li et al.
7,987,584 B2 8/2011 Barna et al.
8,113,883 B2 * 2/2012 Chen ..... H01R 13/6582 439/607.33
8,544,831 B2 10/2013 Klein et al.
8,588,561 B2 * 11/2013 Zbinden ..... G02B 6/4232 385/14
8,764,457 B2 * 7/2014 Chen ..... H05K 7/142 361/810
8,787,711 B2 7/2014 Zbinden et al.
9,166,315 B1 * 10/2015 Phillips ..... H01R 12/722
9,871,325 B2 * 1/2018 Patel ..... H01R 12/721
9,972,927 B2 * 5/2018 Nichols ..... H01R 12/7088
9,991,615 B1 6/2018 Herring et al.
2007/0099470 A1 * 5/2007 Yang ..... H05K 7/1404 439/326
2010/0165592 A1 * 7/2010 Takao ..... G06F 1/185 361/807
2012/0327576 A1 12/2012 Xiao et al.
2014/0094063 A1 4/2014 Daly
2014/0111931 A1 4/2014 Casserly et al.
2014/0179167 A1 6/2014 Long et al.
2015/0318633 A1 * 11/2015 Herring ..... H01R 13/66 439/140
2016/0134040 A1 * 5/2016 Phillips ..... H01R 12/721 439/374
2018/0076587 A1 3/2018 Herring et al.
2018/0309213 A1 10/2018 Harmon et al.

OTHER PUBLICATIONS

TE Connectivity Emboss Assembly DDR1 & DDR2 SODIMM Socket 200P Standard Profile Standard Type, Drawing No. C-1565917, Dec. 2001, 1 page.
U.S. Appl. No. 15/458,099, filed Mar. 14, 2017.
U.S. Appl. No. 15/490,252, filed Apr. 18, 2017.
U.S. Appl. No. 15/492,070, filed Apr. 20, 2017.
U.S. Appl. No. 15/723,287, filed Oct. 3, 2017.

* cited by examiner

DUAL CONNECTOR SYSTEM

BACKGROUND OF THE INVENTION

The subject matter herein relates generally to a dual connector system.

Dual connector systems include first and second electrical connectors mounted to a host circuit board that are electrically connected to a dual connector module. The dual connector module includes a module circuit board having connector interfaces for interfacing with the first and second electrical connectors. Typically communication components are mounted to the module circuit board. For example, electrical and/or optical components may be mounted to the module circuit board. In various applications an on-board optics module may be mounted to the module circuit board. Heat dissipation of the communication components may be provided, such as in the form of a heat sink thermally coupled to the communication components and supported by the module circuit board.

Mating of the dual connector module to the first and second electrical connectors typically involves loading the dual connector module into a first position in a vertical direction and then sliding the dual connector module to a second position in a horizontal direction to mate with the first and second electrical connectors. However, unmating of the dual connector module may be difficult. For example, the dual connector module needs to be moved horizontally rearward out of the card slot at the front end before being lifted upward off of the first and second electrical connectors. Conventional dual connector modules include complex latching components having multiple parts used to release the dual connector module. For example, some conventional dual connector modules use a tether that extends to the rear end of the dual connector module to release the latch and pull the dual connector module rearward. However, some conventional dual connector modules include cables extending from the rear end of the dual connector module that interfere with the tether. Additionally, actuation or pulling on the tether may damage the cables, such as by bending the cables beyond a bend limit of the cables.

A need remains for a dual connector system that provides a mechanism for unmating the dual connector module from the first and second electrical connectors.

BRIEF DESCRIPTION OF THE INVENTION

In one embodiment, a dual connector system is provided including a host circuit board having a front mounting area and a rear mounting area, a first electrical connector at the front mounting area of the host circuit board, and a second electrical connector at the rear mounting area of the host circuit board. The first electrical connector has a housing having a card slot holding first contacts at the card slot being terminated to the host circuit board. The first electrical connector has a latching feature. The second electrical connector has a housing having an upper mating surface holding second contacts at the upper mating surface being terminated to the host circuit board. The dual connector system includes a dual connector module movable between a mated position and an unmated position with the first and second electrical connectors. The dual connector module has a module circuit board including an upper surface and a lower surface facing the host circuit board. The module circuit board has at least one communication component on the upper surface. The module circuit board extends between a front edge and a rear edge. The module circuit board has front contact pads proximate to the front edge for electrically connecting to the first electrical connector. The module circuit board has rear contact pads remote from the front edge for electrically connecting to the second electrical connector. The dual connector module has a front wall proximate to the front edge having a latch at the front wall movable between a latched position and an unlatched position. The latch engages the latching feature of the first electrical connector in the latched position to hold the dual connector module in the mated position with the first electrical connector. The dual connector module has an ejector at the front wall operably coupled to the latch. The ejector is actuated in an actuation direction to release the latch and eject the dual connector module from the mated position to the unmated position after the latch is moved from the latched position to the unlatched position.

In another embodiment, a dual connector system is provided including a host circuit board having a front mounting area and a rear mounting area, a first electrical connector at the front mounting area of the host circuit board, and a second electrical connector at the rear mounting area of the host circuit board. The first electrical connector has a housing having a card slot holding first contacts at the card slot being terminated to the host circuit board. The first electrical connector has a latching feature. The second electrical connector has a housing having an upper mating surface holding second contacts at the upper mating surface being terminated to the host circuit board. The dual connector system includes a dual connector module movable between a mated position and an unmated position with the first and second electrical connectors. The dual connector module has a module circuit board including an upper surface and a lower surface facing the host circuit board. The module circuit board has at least one communication component on the upper surface. The module circuit board extends between a front edge and a rear edge. The module circuit board has front contact pads proximate to the front edge for electrically connecting to the first electrical connector. The module circuit board has rear contact pads remote from the front edge for electrically connecting to the second electrical connector. The dual connector module has a front wall proximate to the front edge. The dual connector module has a latch at the front wall movable between a latched position and an unlatched position. The latch engages the latching feature of the first electrical connector in the latched position. The dual connector module is coupled to the host circuit board by lowering the dual connector module in a loading direction generally perpendicular to the host circuit board to a pre-staged, unmated position where the first connector interface is adjacent to the first electrical connector and the second connector interface is adjacent to the second electrical connector. The dual connector module is slid forward from the pre-staged, unmated position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads. The dual connector module includes an ejector at the front wall being operably coupled to the latch. The ejector is actuated in an actuation direction parallel to the host circuit board to release the latch and eject the dual connector module in an unmating direction from the mated position to the unmated position after the latch is moved from the latched position to the unlatched position.

In a further embodiment, a dual connector system is provided including a host circuit board having a front mounting area and a rear mounting area, a first electrical connector at the front mounting area of the host circuit board, and a second electrical connector at the rear mounting area of the host circuit board. The first electrical connector has a housing having a card slot holding first contacts at the card slot being terminated to the host circuit board. The first electrical connector has a latching feature. The second electrical connector has a housing having an upper mating surface holding second contacts at the upper mating surface being terminated to the host circuit board. The dual connector system includes a dual connector module movable between a mated position and an unmated position with the first and second electrical connectors. The dual connector module has a module circuit board including an upper surface and a lower surface facing the host circuit board. The module circuit board has at least one communication component on the upper surface. The module circuit board extends between a front edge and a rear edge. The module circuit board has front contact pads proximate to the front edge for electrically connecting to the first electrical connector. The module circuit board has rear contact pads remote from the front edge for electrically connecting to the second electrical connector. The dual connector module has a front wall proximate to the front edge having a latch at the front wall movable between a latched position and an unlatched position. The latch engages the latching feature of the first electrical connector in the latched position to hold the dual connector module in the mated position with the first electrical connector. The dual connector module has a shell on the module circuit board and a latch coupled to the shell and being movable between a latched position and an unlatched position. The latch has a base, a support beam extending from the base to a fixed end fixed to the shell, and a latching beam extending from the base being configured to engage the latching feature of the first electrical connector when the dual connector module is in the mated position. The latch is releasable by lifting the latch from the latched position to the unlatched position using an actuator. The support beam is elastically deformed from the fixed end when the latch is moved from the latched position to the unlatched position. The support beam returns to an undeformed state when the lifting force is released to return the latch to the latched position.

DETAILED DESCRIPTION OF THE INVENTION

Figure 1:
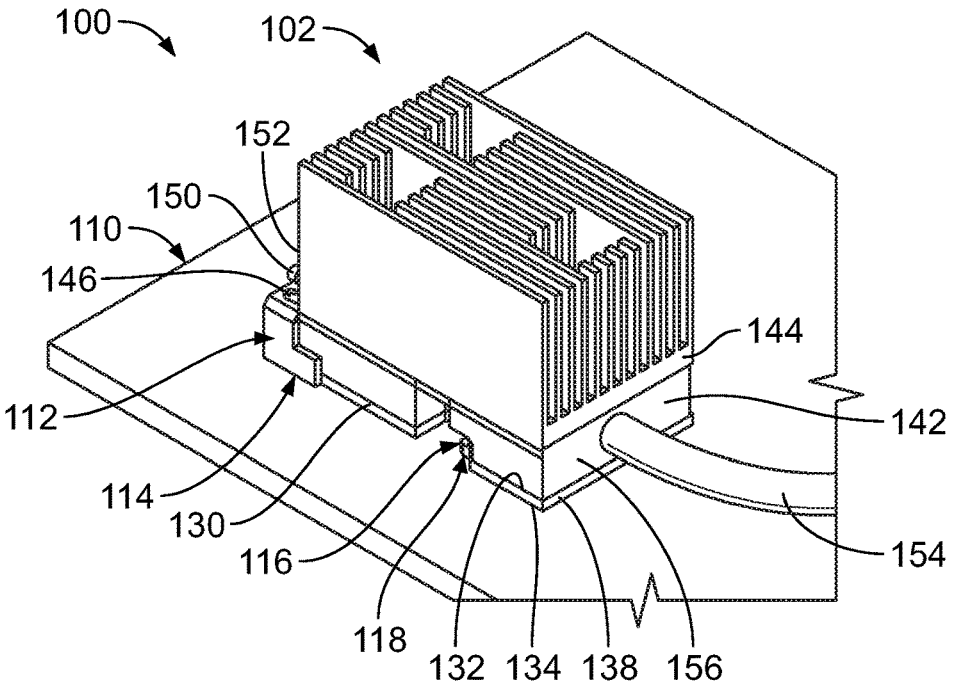
FIG. 1 is a perspective view of a dual connector system formed in accordance with an exemplary embodiment showing a dual connector module mounted to a host circuit board.
Figure 2:
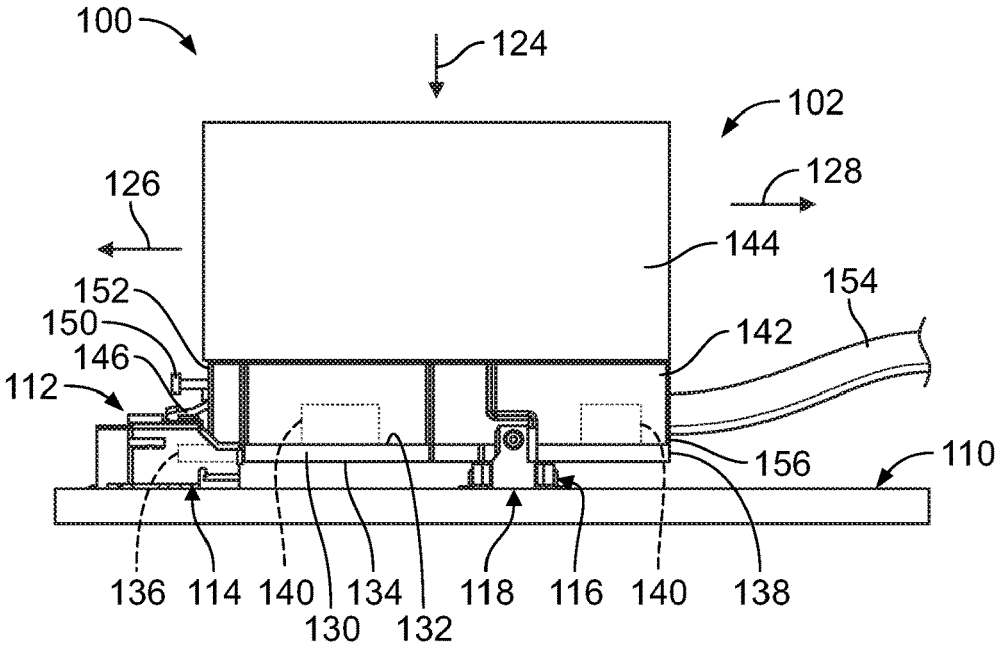
FIG. 2 is a side view of the dual connector system showing the dual connector module mounted to the host circuit board.

FIG. 1 is a perspective view of a dual connector system 100 formed in accordance with an exemplary embodiment showing a dual connector module 102 mounted to a host circuit board 110. FIG. 2 is a side view of the dual connector system 100 showing the dual connector module 102 mounted to the host circuit board 110. The host circuit board 110 has a first electrical connector 112 at a front mounting area 114 of the host circuit board 110 and a second electrical connector 116 at a rear mounting area 118 of the host circuit board 110.

When the dual connector module 102 is mounted to the host circuit board 110, the dual connector module 102 interfaces with both electrical connectors 112, 116. Optionally, the dual connector module 102 may be simultaneously mated with the first and second electrical connectors 112, 116 during a mating process. In an exemplary embodiment, the first electrical connector 112 is a different type of electrical connector than the second electrical connector 116. For example, the first electrical connector 112 may be a front loaded electrical connector, such as a card edge connector. The second electrical connector 116 may be a top loaded electrical connector, such as a mezzanine connector. The electrical connectors 112, 116 may be used for different types of signaling. For example, the first electrical connector 112 may be used for high-speed signaling while the second electrical connector 116 may be used for low speed signaling, powering, or for another type of connection.

In an exemplary embodiment, mating of the dual connector module 102 to the host circuit board 110 occurs by loading the dual connector module 102 in a loading direction 124 (for example, downward) to a pre-staged position and then mating the dual connector module 102 in a mating direction 126 (for example, forward) to a mated position. The dual connector module 102 may be unmated in an opposite unmating direction 128 (for example, rearward) to an unmated position and then removed from the host circuit board 110 by lifting the dual connector module 102 upward. The loading direction 124 may be perpendicular to the host circuit board 110, such as in a vertical direction, and the mating and unmating directions 126, 128 may be parallel to the host circuit board 110, such as in horizontal directions. In an exemplary embodiment, the dual connector module 102 is moved in the unmating direction 128 using an ejector 150 at a front end 152 of the dual connector module 102 that pushes the dual connector module 102 rearward.

The dual connector module 102 includes a module circuit board 130 having an upper surface 132 and a lower surface 134. The module circuit board 130 extends between a front edge 136 (shown in phantom) and a rear edge 138. The lower surface 134 faces the host circuit board 110 and may be parallel to and spaced apart from the host circuit board 110 when mated to the electrical connectors 112, 116.

In an exemplary embodiment, the dual connector module 102 includes one or more communication components 140 on the upper surface 132 and/or the lower surface 134. The communication components 140 may be electrical components, optical components, or other types of components. In an exemplary embodiment, one or more of the communication components 140 may be on-board optical modules. The communication components 140 may include optical/digital converters for converting between optical and electrical signals. Other types of communication components 140 may be provided on the module circuit board 130, such as processors, memory modules, antennas, or other types of components.

In an exemplary embodiment, the dual connector module 102 includes a housing or shell 142 on the upper surface 132. The shell 142 encloses the communication components 140. In an exemplary embodiment, the shell 142 extends generally around the perimeter of the module circuit board 130; however, portions of the module circuit board 130 may be exposed exterior of the shell 142. In an exemplary embodiment, the dual connector module 102 includes a heat sink 144 thermally coupled to one or more of the communication components 140. The heat sink 144 dissipates heat from the communication components 140. The heat sink 144 may be mounted to the shell 142 and/or the module circuit board 130. In an exemplary embodiment, the heat sink 144 extends substantially the entire length of the dual connector module 102. The heat sink 144 may have a plurality of fins having a large surface area for dissipating heat.

In an exemplary embodiment, the dual connector module 102 includes a latch 146 at the front end 152 of the dual connector module 102 for latchably securing the dual connector module 102 to the first electrical connector 112. The ejector 150 is coupled to the latch 146 for releasing the latch 146. In the illustrated embodiment, the latch 146 and the ejector 150 both extend forward of the front end 152 of the dual connector module 102, such as forward of the shell 142. In an exemplary embodiment, the latch 146 is coupled to and supported by the shell 142 and/or the ejector 150 is coupled to and supported by the shell 142. The ejector 150 is configured to be pushed inward into the shell 142 to an actuated position to release the latch 146 from a latched position to an unlatched position. In an exemplary embodiment, the ejector 150 is used to lift the latch 146 upward, such as in a direction perpendicular to the mating direction of the module circuit board 130, to release the latch 146. Once the latch 146 is released, the dual connector module 102 is able to be moved rearward in the unmating direction 128. The latch 146 may be pivoted upward from the latched position to the unlatched position. The latch may be pivoted downward to return from the unlatched position to the latched position. Optionally, as the latch 146 is returned downward, the latch 146 may force the ejector 150 forward to return to a released position. In other various embodiments, another component, such as a return spring may be used to return the ejector 150 to the released position.

In an exemplary embodiment, the ejector 150 is at the front end 152 and is accessible from above the dual connector module 102. For example, because one or more cables 154 extend from a rear end 156 of the dual connector module 102, the cable 154 may block access to the space rearward of the dual connector module 102. Routing of a tether or other latch release component to the rear end 156 of the dual connector module 102 may be impractical because of the location of the cable 154 or limited access to the space behind the dual connector module 102. Actuation of a tether may damage the cable 154, such as from bending of the cable 154 out of the way to access the tether.

Figure 3:
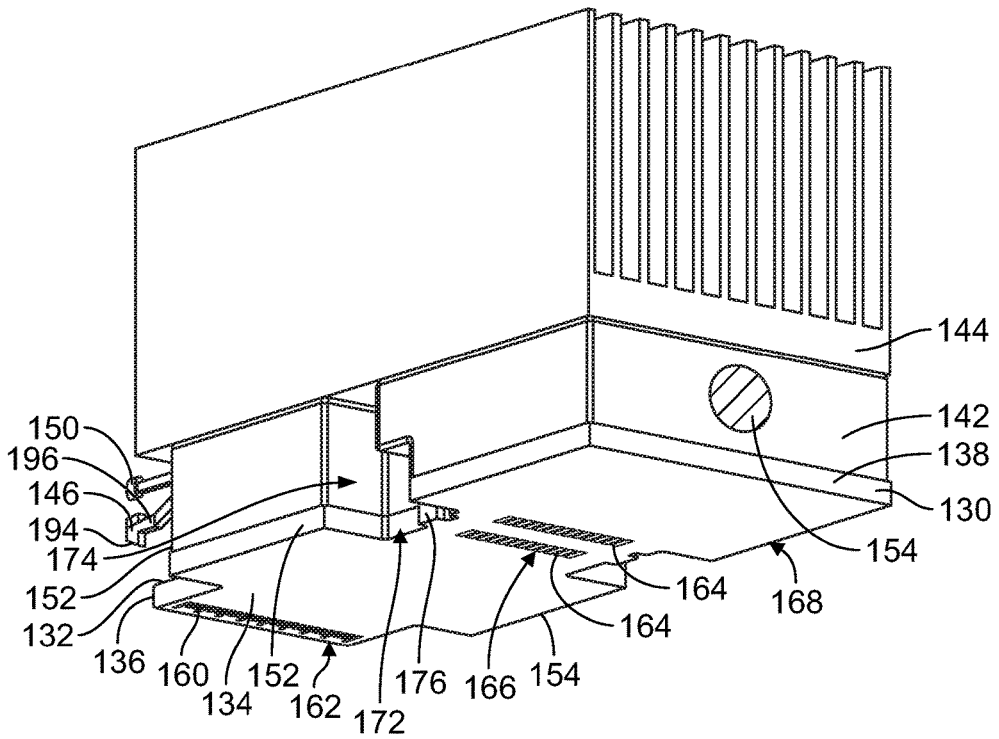
FIG. 3 is a bottom perspective view of the dual connector module in accordance with an exemplary embodiment.

FIG. 3 is a bottom perspective view of the dual connector module 102 in accordance with an exemplary embodiment. In an exemplary embodiment, the module circuit board 130 includes front contact pads 160 proximate to the front edge 136 along the lower surface 134 and/or the upper surface 132. The front contact pads 160 define a first connector interface 162 configured for electrically connecting to the first electrical connector 112 (shown in FIG. 2). For example, the first connector interface 162 may be a card edge interface at the front edge 136 configured to be plugged into a card slot of the first electrical connector 112. The front contact pads 160 are circuits of the module circuit board 130. The front contact pads 160 may be electrically connected to corresponding communication components 140 (shown in FIG. 2) via traces on various layers of the module circuit board 130. In an exemplary embodiment, the front contact pads 160 convey high speed data signals. Optionally, various front contact pads 160 may be arranged in pairs configured to carry differential signals.

The module circuit board 130 includes rear contact pads 164 on the lower surface 134 that define a second connector interface 166 configured for electrically connecting to the second electrical connector 116 (shown in FIG. 2). The rear contact pads 164 may be electrically connected to corresponding communication components 140 via traces on various layers of the module circuit board 130. Optionally, at least some of the rear contact pads 164 may be power pads configured to transmit power between the second electrical connector 116 and the module circuit board 130 for powering the communication components 140. Optionally, the rear contact pads 164 may be provided in multiple rows along the lower surface 134. The rear contact pads 164 are provided at an intermediate portion 168 of the module circuit board 130 remote from the front edge 136 and remote from the rear edge 138. Optionally, the rear contact pads 164 are positioned closer to the rear edge 138 than the front edge 136 and may be positioned at the rear edge 138 in some embodiments.

The module circuit board 130 includes cutouts 172 at the side edges near the intermediate portion 168. The shell 142 includes pockets 174 above the cutouts 172. The cutouts 172 and the pockets 174 are configured to receive portions of the second electrical connector 116 during mating of the dual connector module 102 to the second electrical connector 116 (FIG. 2). In an exemplary embodiment, the module circuit board 130 includes landing pads 176 extending into the cutouts 172. The landing pads 176 are configured to be engaged by the second electrical connector 116 to mechanically secure the dual connector module 102 to the second electrical connector 116.

The latch 146 and the ejector 150 are provided at the front end 152, such as at a front wall 190 of the shell 142. The latch 146 includes one or more latching beams 192. For example, in the illustrated embodiment, the latch 146 includes two latching beams 192 located near the opposite sides of the dual connector module 102. The ejector 150 may be approximately centered between the latching beams 192 and/or between the sides of the dual connector module 102. The latch 146 may be pivotably coupled to the front wall 190 of the shell 142. In an exemplary embodiment, each latching beam 192 includes a hook 194 at the distal end thereof for latching to a corresponding latching feature of the first electrical connector 112.

Figure 4:
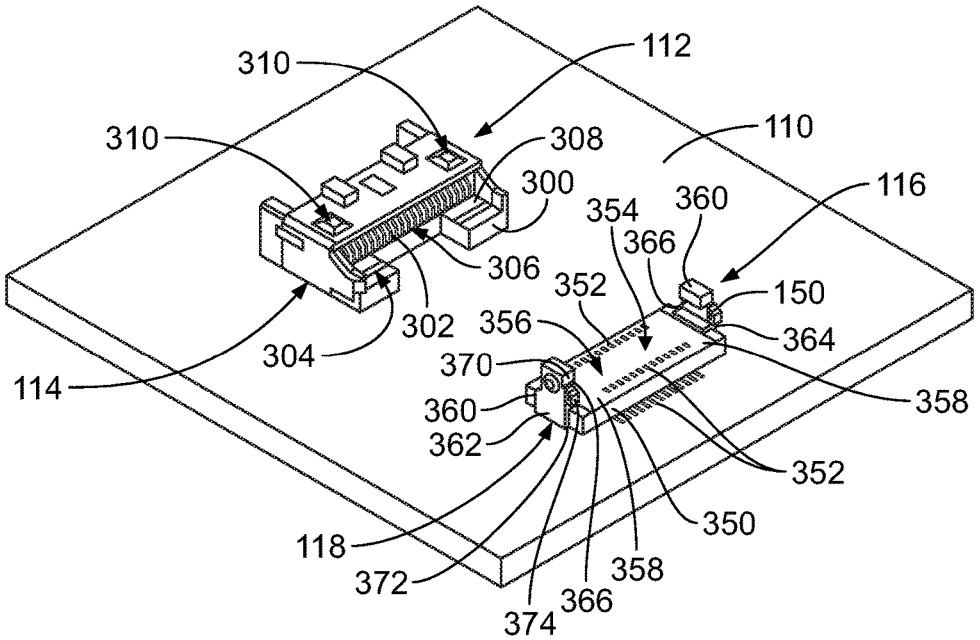
FIG. 4 is a top perspective view of the host circuit board in accordance with an exemplary embodiment.

FIG. 4 is a top perspective view of the host circuit board 110 in accordance with an exemplary embodiment. The host circuit board 110 includes mounting areas for mounting the dual connector module 102 (shown in FIG. 3) to the host circuit board 110. The mounting area is subdivided into the front mounting area 114 receiving the first electrical connector 112 and the rear mounting area 118 receiving the second electrical connector 116.

With additional reference to FIG. 3 for reference to components of the dual pluggable module 102, the first electrical connector 112 includes a housing 300 mounted to the host circuit board 110. The housing 300 holds a plurality of first contacts 302 configured to be terminated to the host circuit board 110. The housing 300 has a mating end 304 configured to be mated with the first connector interface 162 (FIG. 3) of the dual connector module 102. In an exemplary embodiment, the first electrical connector 112 includes a card slot 306 at the mating end 304. The first contacts 302 are arranged in the card slot 306 for mating with the first connector interface 162. For example, the first contacts 302 may be arranged in an upper row and a lower row for interfacing with the front contact pads 160 (FIG. 3) on the upper surface 132 and the lower surface 134 at the front edge 136 of the module circuit board 130.

The housing 300 includes locating surfaces 308 at the mating end 304 for locating the module circuit board 130 relative to the card slot 306 during mating. For example, the locating surfaces 308 may be upward facing surfaces configured to support the front edge 136 of the module circuit board 130 in the pre-staged position. The module circuit board 130 may slide along the locating surfaces 308 during mating as the front edge 136 of the module circuit board 130 is loaded into the card slot 306. The locating surfaces 308 may support the module circuit board 130 in the mated position to prevent damage to the first contacts 302 from the weight of the dual connector module 102.

The housing 300 includes one or more latching features 310. The latching features 310 interact with the latch 146 of the dual connector module 102 to secure the dual connector module 102 to the first electrical connector 112. For example, in the illustrated embodiment, the latching features 310 are openings in the top surface of the housing 300 that receive the hooks 194 of the latch 146. The hooks 194 are releasable from the latching features 310. In a latched position, the hooks 194 are received in the latching features 310 and retain the relative position of the dual connector module 102 with respect to the first electrical connector 112. For example, the latch 146 retains the front edge 136 of the module circuit board 130 in the card slot 306. When the latch 146 is released to an unlatched position, such as by pushing the ejector 150 inward, the dual connector module 102 may be unmated from the first electrical connector 112. For example, the dual connector module 102 may be moved rearward, such as by pushing the ejector 150 rearward.

Figure 5:
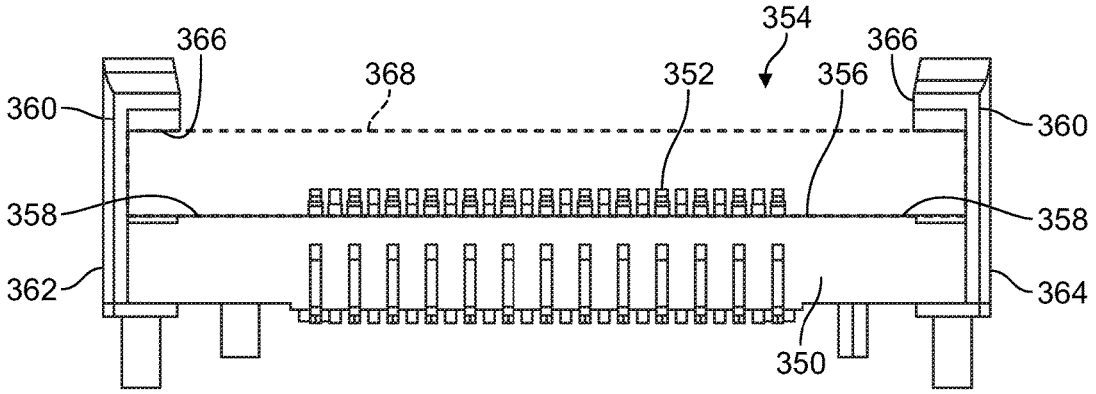
FIG. 5 is an end view of a second electrical connector of the host circuit board in accordance with an exemplary embodiment.

With additional reference to FIG. 5, which is an end view of the second electrical connector 116 in accordance with an exemplary embodiment, the second electrical connector 116 includes a housing 350 mounted to the host circuit board 110. The housing 350 holds a plurality of second contacts 352 configured to be terminated to the host circuit board 110. The housing 350 has a mating end 354 (for example, defining the top) configured to be mated with the second connector interface 166 (FIG. 3) of the dual connector module 102. In an exemplary embodiment, the second electrical connector 116 includes an upper mating surface 356 at the mating end 354. The second contacts 352 are arranged along the upper mating surface 356, such as in one or more rows, for mating with the second connector interface 166. The second contacts 352 may include deflectable spring beams configured to be resiliently biased against the second connector interface 166 when the dual connector module 102 is mated to the second electrical connector 116.

The housing 350 includes locating surfaces 358 at the mating end 354 for locating the module circuit board 130 during mating. For example, the locating surfaces 358 may be upward facing surfaces configured to support the intermediate portion 168 of the module circuit board 130. The housing 350 includes towers 360 extending above the locating surfaces 358, such as at opposite sides 362, 364 of the housing 350. The towers 360 may be integral with the base of the housing 350; however, the towers 360 may be separate components mounted to the base of the housing 350 in alternative embodiments. For example, the towers 360 may be die cast metal components attached to a molded plastic base of the housing 350 and/or the host circuit board 110 to provide additional rigidity for support and holding strength for the module circuit board 130 and/or to provide higher precision manufacturing and locating for the module circuit board 130.

The towers 360 include ledges 366, such as at distal or top ends of the towers 360, extending over the second electrical connector 116. The towers 360 and the ledges 366 form a gap 368 above the upper mating surface 356 that receives the module circuit board 130. The ledges 366 are configured to engage the upper surface 132 of the module circuit board 130, such as at the landing pads 176 (FIG. 3), to retain the module circuit board 130 in the gap 368 between the ledges 366 and the upper mating surface 356. The ledges 366 prevent lift-off of the module circuit board 130 when the dual connector module 102 is in the mated position. The module circuit board 130 is configured to bypass the towers 360 as the dual connector module 102 is loaded to the pre-staged position; however, when the dual connector module 102 is slid forward to the mated position, the module circuit board 130 is slid under the ledges 366 to the mated position.

The module circuit board 130 may slide along the locating surfaces 358 during mating as the front edge 136 of the module circuit board 130 is loaded into the card slot 306. The locating surfaces 358 may support the module circuit board 130, such as at the intermediate portion 168, in the mated position to prevent damage to the second contacts 352 from the weight of the dual connector module 102.

Figure 6:
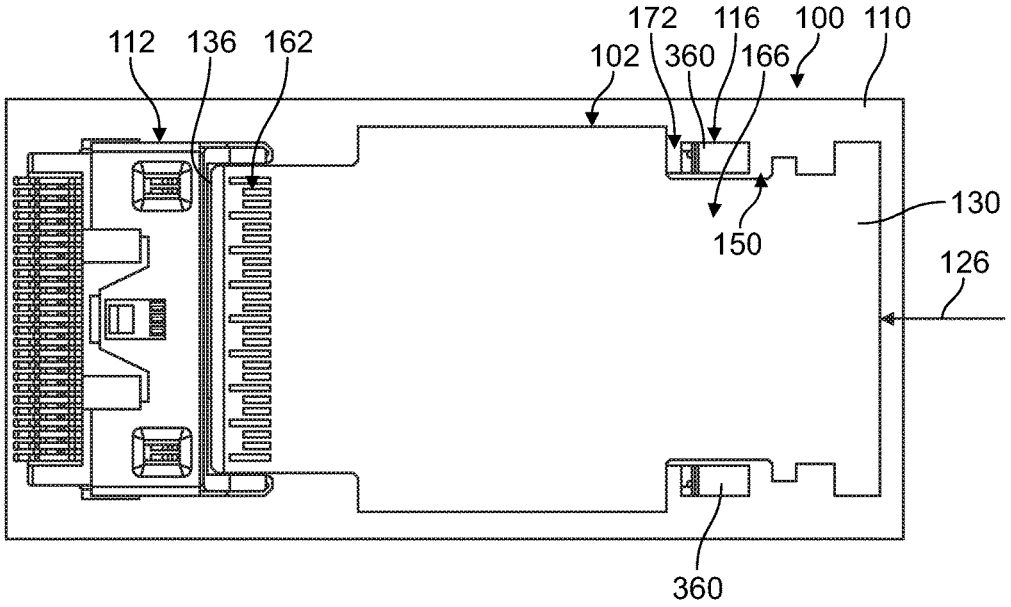
FIG. 6 is a top view of a portion of the dual connector system showing a module circuit board partially mated to the host circuit board.
Figure 7:
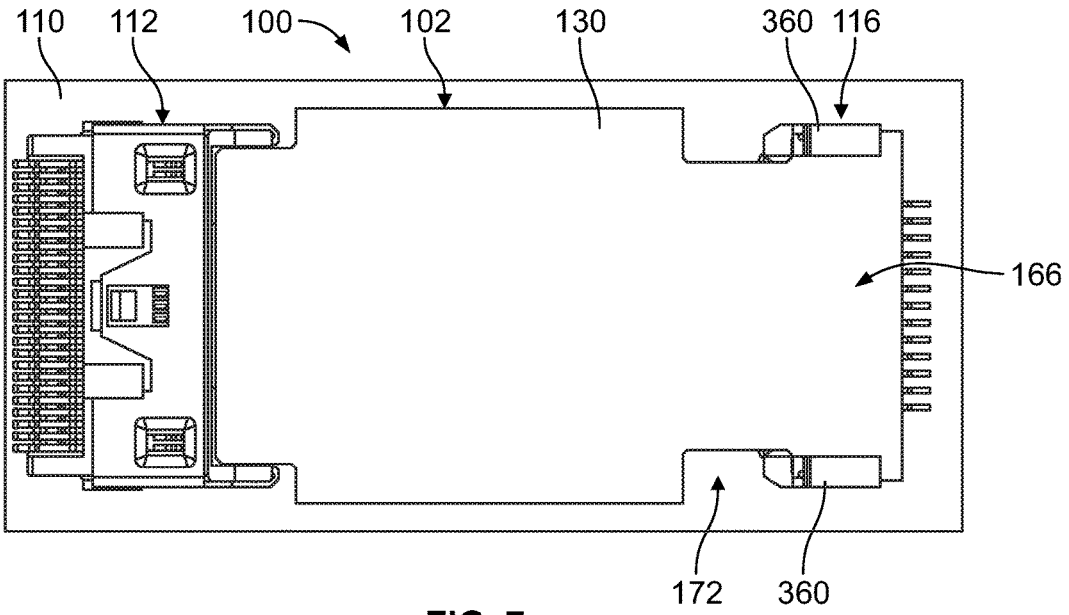
FIG. 7 is a top view of a portion of the dual connector system showing the module circuit board fully mated to the host circuit board.

FIG. 6 is a top view of a portion of the dual connector system 100 showing the module circuit board 130 partially mated to the host circuit board 110. FIG. 7 is a top view of a portion of the dual connector system 100 showing the module circuit board 130 fully mated to the host circuit board 110. The release mechanisms 150 extend from the towers 360 to engage the module circuit board 130; however the release mechanisms 150 may extend from the dual connector module 102 to engage the second electrical connector 116 or the first electrical connector 112 in alternative embodiments.

In an exemplary embodiment, mating of the dual connector module 102 to the host circuit board 110 (and the electrical connectors 112, 116) occurs by loading the dual connector module 102 in the loading direction 124 (shown in FIG. 2) to the pre-staged, unmated position (FIG. 6), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 7).

During mating, the first connector interface 162 is generally aligned above the first electrical connector 112 and the second connector interface 166 is generally aligned above the second electrical connector 116 and the module circuit board 130 is lowered into position on the first and second electrical connectors 112, 116 to the pre-staged, unmated position. The front edge 136 of the module circuit board 130 rests on, and is supported by, the first electrical connector 112 in the pre-staged, unmated position (FIG. 6). As the module circuit board 130 is lowered, the towers 360 of the second electrical connector 116 extend into the cutouts 172 in the module circuit board 130. The release mechanisms 150 are received in the cutouts 172 at opposite sides of the module circuit board 130.

As the dual connector module 102 is moved from the pre-staged, unmated position (FIG. 6) to the mated position (FIG. 7), the dual connector module 102 is latchably secured to the first electrical connector 112, as described above. However, when the latch 146 (shown in FIG. 3) is released, the dual connector module 102 may be pushed rearward by the ejector 150 to cause the dual connector module 102 to shift rearward to the unmated position.

Figure 8:
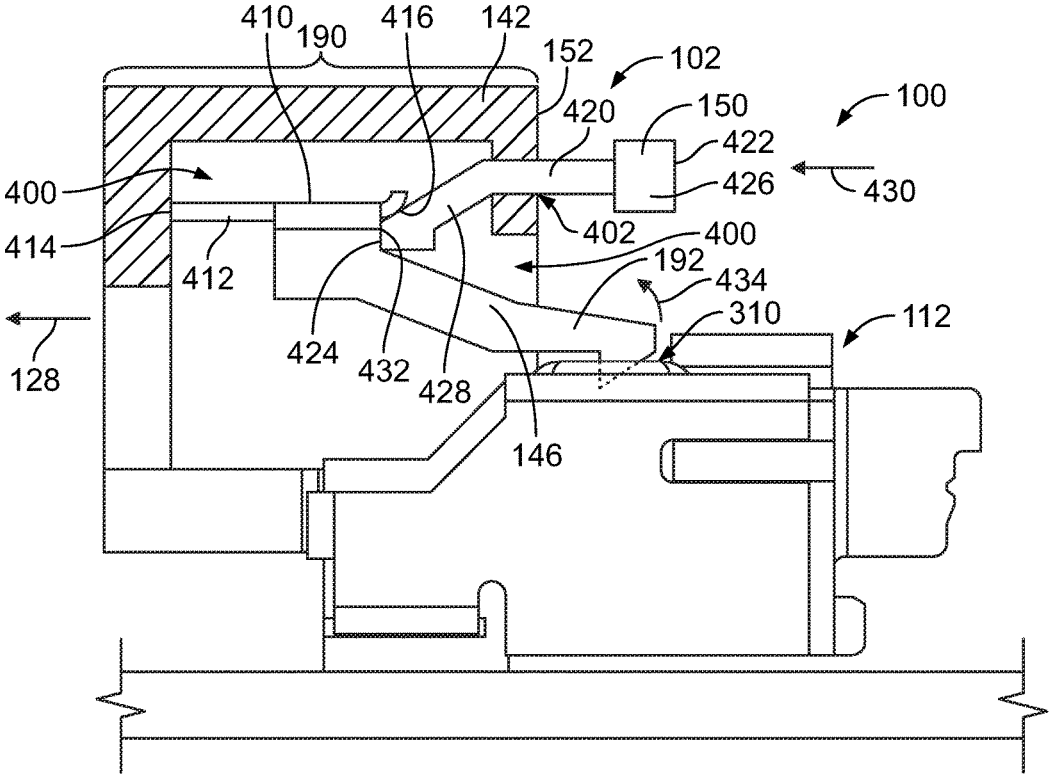
FIG. 8 is a side, partial sectional view of a portion of the dual connector system showing the dual connector module mated to a first electrical connector.
Figure 9:
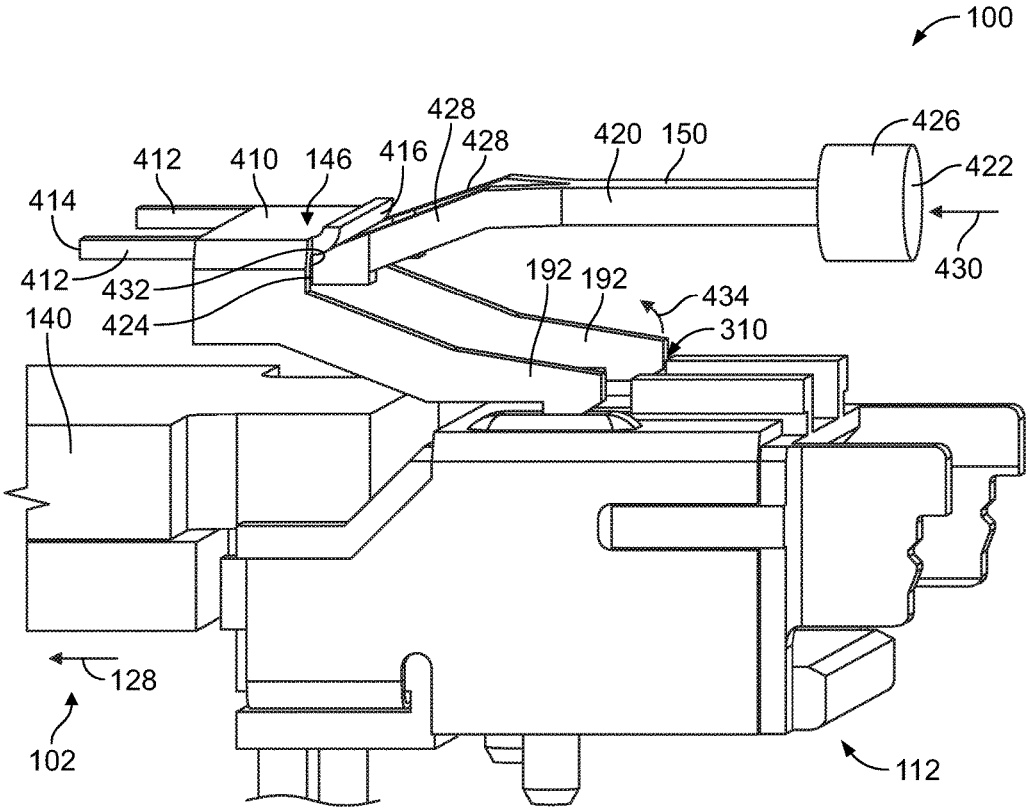
FIG. 9 is a perspective view of a portion of the dual connector system showing the dual connector module mated to the first electrical connector.

FIG. 8 is a side, partial sectional view of a portion of the dual connector system 100 showing the dual connector module 102 mated to the first electrical connector 112. FIG. 9 is a perspective view of a portion of the dual connector system 100 showing the dual connector module 102 mated to the first electrical connector 112. FIG. 8 shows a portion of the dual connector module 102 in-section to illustrate the latch 146 and the ejector 150. FIG. 9 has a portion of the dual connector module 102, such as the shell 142, removed to illustrate the latch 146 and the ejector 150. FIGS. 8 and 9 illustrate the latch 146 in a latched position and illustrate the ejector in a released position.

The shell 142 includes the front wall 190 at the front end 152. The front wall 190 may include multiple wall portions defining the front wall 190, such as an inner wall portion and an outer wall portion and may include a gap or space between the wall portions. The front wall 190 extends forward of the communication component 140 and may extend over the top of the communication component 140. In an exemplary embodiment, the front wall 190 is used to support the latch 146 and the ejector 150. For example, the latch 146 may be movably coupled to the front wall 190 and/or the ejector 150 may be movably coupled to the front wall 190. In the illustrated embodiment, a portion of the latch 146 is fixed to and cantilevered from the front wall 190 such that the latch 146 is pivotable about the fixed point with the front wall 190. The latch 146 may be rotated between the latched and the unlatched positions from the fixed location on the front wall 190. The front wall 190 includes pockets or slots 400 that allow the latch 146 to move within the front wall 190. The latching beams 192 extend through the slots 400 forward of the front wall 190. In the illustrated embodiment, a portion of the ejector 150 extends through the front wall 190 to interface with the latch 146. The ejector 150 is movable forward and rearward relative to the front wall 190 between the released and actuated positions. The front wall 190 includes pockets or slots 402 that allow the ejector 150 to move within the front wall 190.

The latch 146 includes a base 410 and one or more support beams 412 extending from the base 410 to fixed ends 414 configured to be fixed to the shell 142 at the front wall 190. In the illustrated embodiment, the support beams 412 extend rearward from the base 410. The latching beams 192 extend from the base 410. In the illustrated embodiment, the latching beams 192 extend forward from the base 410. The support beams 412 are configured to be resiliently deformed as the latch 146 is moved from the latched position to the unlatched position. For example, the support beams 412 may be elastically deformed as the latch 146 is moved from the latched position to the unlatched position. When the latch 146 is released, the support beams 412 may return to the undeformed state. For example, the support beams 412 may act as springs imparting a return force to return the latch 146 to the latched position.

In an exemplary embodiment, the latch 146 includes a cam surface 416. For example, in the illustrated embodiment, the cam surface 416 is provided at the front end of the base 410. The cam surface 416 is curved. The ejector 150 engages the cam surface 416. When the ejector 150 is pressed rearward, the ejector 150 engages the cam surface 416 and/or the base 410 to drive the latch 146 to the unlatched position. When the ejector 150 is released, the cam surface 416 engages the ejector 150 and the return force returning the latch 146 to the latched position forces the ejector 150 to return to the released position. For example, as the support beams 412 forces the latch 146 downward to return to the latched position, the cam surface 416 drives against the ejector 150 to return the ejector 150 to the released position as the latch 146 is moved downward from the unlatched position to the latched position. Other types of return mechanisms may be used in alternative embodiments, such as a return spring acting on the latch 146 and/or the ejector 150.

The ejector 150 includes a body 420 extending between an actuation end 422 and a latch end 424. The ejector 150 includes an actuator 426 at the actuation end 422. In the illustrated embodiment, the actuator 426 is a button configured to be pressed rearward by an operator. Other types of actuators may be provided in alternative embodiments. The latch end 424 is configured to engage the latch 146. In the illustrated embodiment, the latch end 424 engages the front end of the latch 146, such as at the cam surface 416. In an exemplary embodiment, the ejector 150 includes a pair of ramps 428 at the latch end 424 that are positioned under the latch 146 and used to drive the latch 146 upward from the latched position to the unlatched position as the ejector 150 is pushed rearward. For example, the body 420 may be Y-shaped having the pair of ramps 428 at the latch end 424 and having a single trunk extending to the actuator 426. The ramps 428 are spread apart from each other to engage opposite sides of the base 410 to lift the latch 146 at two different points to ensure even lifting of the latch 146.

In an exemplary embodiment, the ejector 150 is accessible forward of the dual connector module 102 immediately above the first electrical connector 112. The ejector extends forward of the front wall 190 and is configured to be pushed rearward toward the front wall 190 to actuate the latch 146. The ejector 150 is actuated in an actuation direction 430 to release the latch 146 and eject the dual connector module 102 rearward in the unmating direction 128 from the mated position to the unmated position after the latch 146 is moved from the latched position to the unlatched position. For example, the ejector 150 is pushed rearward and driven into the latch 146. The ramps 428 lift the latch 146 to the unlatched position. As the ejector 150 is pushed rearward, and when the latch 146 is released from the latching features 310, the rearward force on the ejector 150 forces the dual connector module 102 rearward. For example, the body 420 may press against a portion of the dual connector module 102, such as the front wall 190. In various embodiments, the latch 146 includes pressing surfaces 432, such as on the base 410 or the latching beams 192. The ramps 428 may press against the pressing surfaces 432 to force the dual connector module 102 rearward. The ejector 150 forces the dual connector module 102 in the unmating direction 128 as the ejector 150 is actuated in the actuation direction 430 after the latch 146 is moved to the unlatched position.

The ejector 150 is movable linearly parallel to the host circuit board 110 between the released position and the actuated position. For example, the ejector 150 is movable in a linear acting direction parallel to the actuation direction 430 to lift the latch 146 upward. When the ejector 150 is actuated, the latch 146 is lifted upward in an unlatching direction 434 perpendicular to the acting direction of the ejector 150. In an exemplary embodiment, because the support beams 412 are fixed to the front wall 190, the latch 146 is rotated upward from the latched position to the unlatched position as the ejector 150 is moved rearward to the actuated position. When the ejector 150 is released, the latch 146 is rotated downward from the unlatched position to the latched position. As the latch 146 returns downward, the latch 146 causes the ejector 150 to move forward to the released position. The cam surface 416 drives the ejector 150 forward as the latch 146 moves downward.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board, the first electrical connector having a latching feature;

a second electrical connector at the rear mounting area of the host circuit board, the second electrical connector having a housing having an upper mating surface, the housing holding second contacts at the upper mating surface, the second contacts being terminated to the host circuit board;

a dual connector module movable between a mated position and an unmated position with the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector, the dual connector module having a front wall proximate to the front edge, the dual connector module having a latch at the front wall movable between a latched position and an unlatched position, the latch engaging the latching feature of the first electrical connector in the latched position to hold the dual connector module in the mated position with the first electrical connector, the dual connector module having an ejector at the front wall operably coupled to the latch, the ejector being actuated in an actuation direction to release the latch and eject the dual connector module from the mated position to the unmated position after the latch is moved from the latched position to the unlatched position.

2. The dual connector system of claim 1, wherein the ejector forces the dual connector module in an unmating direction as the ejector is actuated after the latch is moved to the unlatched position.

3. The dual connector system of claim 1, wherein the latch includes a support beam imparting a return force to return the latch to the latched position.

4. The dual connector system of claim 3, wherein the return force forces the ejector to return to a released position.

5. The dual connector system of claim 1, wherein the latch is lifted upward in an unlatching direction perpendicular to the acting direction of the ejector.

6. The dual connector system of claim 1, wherein the latch includes a latching beam engaging the latching feature and a support beam fixed to the front wall, the support beam being elastically deformed as the latch is moved from the latched position to the unlatched position, the support beam returning to an undeformed state when the ejector is released to return the latch to the latched position.

7. The dual connector system of claim 1, wherein the ejector extends forward of the front wall and is pushed rearward toward the front wall to actuate the latch, the ejector pushing the dual connector module rearward to the unmated position after the latch is released to the unlatched position.

8. The dual connector system of claim 1, wherein the latch includes a cam surface, the ejector engaging the cam surface, the cam surface causing the ejector to return to a released position as the latch is moved downward from the unlatched position to the latched position.

9. The dual connector system of claim 1, wherein the ejector is movable linearly parallel to the host circuit board between a released position and an actuated position, the latch being rotated upward from the latched position to the unlatched position as the ejector is moved rearward to the actuated position and rotated downward from the unlatched position to the latched position to cause the ejector to move forward to the released position.

10. The dual connector system of claim 1, wherein the ejector is accessible forward of the dual connector module immediately above the first electrical connector.

11. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board, the first electrical connector having a latching feature;

a second electrical connector at the rear mounting area of the host circuit board, the second electrical connector having a housing having an upper mating surface, the housing holding second contacts at the upper mating surface, the second contacts being terminated to the host circuit board;

a dual connector module matable with the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector, the dual connector module having a front wall proximate to the front edge, the dual connector module having a latch at the front wall movable between a latched position and an unlatched position, the latch engaging the latching feature of the first electrical connector in the latched position, wherein the dual connector module is coupled to the host circuit board by lowering the dual connector module in a loading direction generally perpendicular to the host circuit board to a pre-staged, unmated position where the first connector interface is adjacent to the first electrical connector and the second connector interface is adjacent to the second electrical connector, and wherein the dual connector module is slid forward from the pre-staged, unmated position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads; and an ejector provided at the front wall being operably coupled to the latch, the ejector is actuated in an actuation direction parallel to the host circuit board to release the latch and eject the dual connector module in an unmating direction from the mated position to the unmated position after the latch is moved from the latched position to the unlatched position.

12. The dual connector system of claim 11, wherein the ejector forces the dual connector module in an unmating direction as the ejector is actuated after the latch is moved to the unlatched position.

13. The dual connector system of claim 11, wherein the latch imparts a return force to force the ejector to return to a released position.

14. The dual connector system of claim 11, wherein the latch is lifted upward in an unlatching direction perpendicular to the acting direction of the ejector.

15. The dual connector system of claim 11, wherein the latch includes a latching beam engaging the latching feature and a support beam fixed to the front wall, the support beam being elastically deformed as the latch is moved from the latched position to the unlatched position, the support beam returning to an undeformed state when the ejector is released to return the latch to the latched position.

16. The dual connector system of claim 11, wherein the ejector extends forward of the front wall and is pushed rearward toward the front wall to actuate the latch, the ejector pushing the dual connector module rearward to the unmated position after the latch is released to the unlatched position.

17. The dual connector system of claim 11, wherein the latch includes a cam surface, the ejector engaging the cam surface, the cam surface causing the ejector to return to a released position as the latch is moved downward from the unlatched position to the latched position.

18. The dual connector system of claim 11, wherein the ejector is movable linearly parallel to the host circuit board between a released position and an actuated position, the latch being rotated upward from the latched position to the unlatched position as the ejector is moved rearward to the actuated position and rotated downward from the unlatched position to the latched position to cause the ejector to move forward to the released position.

19. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board, the first electrical connector having a latching feature;

a second electrical connector at the rear mounting area of the host circuit board, the second electrical connector having a housing having an upper mating surface, the housing holding second contacts at the upper mating surface, the second contacts being terminated to the host circuit board;

a dual connector module movable between a mated position and an unmated position with the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector, the dual connector module having a shell on the module circuit board;

a latch coupled to the shell and being movable between a latched position and an unlatched position, the latch having a base, a support beam extending from the base to a fixed end fixed to the shell, and a latching beam extending from the base being configured to engage the latching feature of the first electrical connector when the dual connector module is in the mated position, the latch being releasable by lifting the latch from the latched position to the unlatched position using an actuator, the support beam being elastically deformed from the fixed end when the latch is moved from the latched position to the unlatched position, the support beam returning to an undeformed state when the lifting force is released to return the latch to the latched position.

20. The dual connector system of claim 19, wherein the dual connector module includes an ejector defining the actuator, the ejector being provided at the front wall and being operably coupled to the latch, the ejector being actuated in an actuation direction parallel to the host circuit board to release the latch and eject the dual connector module in an unmating direction from the mated position to the unmated position after the latch is moved from the latched position to the unlatched position.

* * * * *